US011501723B2

(12) United States Patent
Chen et al.

(10) Patent No.: US 11,501,723 B2
(45) Date of Patent: Nov. 15, 2022

(54) DISPLAY DEVICE AND OPERATION METHOD OF BACK LIGHT MODULE

(71) Applicant: Qisda Corporation, Taoyuan (TW)

(72) Inventors: Wei-Jou Chen, Taoyuan (TW); Chen-Yang Hu, Taoyuan (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 17/202,421

(22) Filed: Mar. 16, 2021

(65) Prior Publication Data

US 2021/0312876 A1 Oct. 7, 2021

(30) Foreign Application Priority Data

Apr. 1, 2020 (TW) ..... 109111277

(51) Int. Cl.
*G09G 3/34* (2006.01)
*G09G 3/30* (2006.01)

(52) U.S. Cl.
CPC ..... *G09G 3/3406* (2013.01); *G09G 2320/064* (2013.01)

(58) Field of Classification Search
CPC ..... G09G 2310/08; G09G 3/20; G06F 3/0412
See application file for complete search history.

(56) References Cited

U.S. PATENT DOCUMENTS

2007/0040774 A1* 2/2007 Lee ..... G09G 3/3233 345/77
2018/0315379 A1* 11/2018 Du ..... G09G 5/12

FOREIGN PATENT DOCUMENTS

CN 105489171 A 4/2016
CN 109859696 A 6/2019

OTHER PUBLICATIONS

Office action of counterpart application by Taiwan IP Office dated Mar. 11, 2020.
Office action of counterpart application by Taiwan IP Office dated Mar. 11, 2021.

* cited by examiner

*Primary Examiner* — Nan-Ying Yang

(57) ABSTRACT

An operation method of a backlight module is disclosed. The operation method includes: determining whether a first video synchronization signal is received; in response to a determination that the first video synchronization signal is received, activating a counter, and controlling the backlight module to emit light a specific number of times at a first brightness for a first time period; determining whether the counter is timeout and a second video synchronization signal is not received; and in response to a determination that the counter is timeout and the second video synchronization signal is not received, controlling the backlight module to switch between lighting and not lighting multiple times within a second time period.

20 Claims, 2 Drawing Sheets

DISPLAY DEVICE AND OPERATION METHOD OF BACK LIGHT MODULE

This application claims the benefit of Taiwan application Serial No. 109111277, filed Apr. 1, 2020, the subject matter of which is incorporated herein by reference.

BACKGROUND OF THE INVENTION

Field of the Invention

The invention relates in general to a display device and an operation method of a backlight module.

Description of the Related Art

The LCD displays images in a hold type manner. Therefore, when a viewer tracks a moving object on the screen using his/her two eyes, the viewer will experience motion blur due to visual persistence. To resolve the above problem, the conventional LCD screen adopts a black frame insertion method. The black frame insertion method refers to the arrangement that during a frame display period, the LCD displays a black frame alternately. However, such method is applicable only to the LCD with fixed refresh rate (FRR), but not the LCD with variable refresh rate (VRR). This is because the refresh rate of a LCD with fixed refresh rate varies with the time, making the viewer feel that the brightness of the frame displayed at different refresh rates is not the same.

SUMMARY OF THE INVENTION

According to one embodiment the present invention, a display device is disclosed. The display device includes a liquid crystal panel, a backlight module and a control unit. The liquid crystal panel has a variable refresh rate, which ranges from a first frequency to a second frequency higher than the first frequency. The backlight module overlaps the liquid crystal panel. The control unit is coupled to the backlight module and is configured to: determine whether a first video synchronization signal is received; in response to a determination that the first video synchronization signal is received, activate a counter, and control the backlight module to emit light a specific number of times at a first brightness for a first time period; determine whether the counter is timeout and a second video synchronization signal is not received; and in response to a determination that the counter is timeout and the second video synchronization signal is not received, control the backlight module to switch between lighting and not lighting multiple times within a second time period.

According to another embodiment the present invention, an operation method of a backlight module performed by a control unit of a display device is disclosed. The display device includes a liquid crystal panel and a backlight module. The liquid crystal panel has a variable refresh rate, which ranges from a first frequency to a second frequency higher than the first frequency. The operation method including: determining whether a first video synchronization signal is received; in response to a determination that the first video synchronization signal is received, activating a counter, and controlling the backlight module to emit light a specific number of times at a first brightness for a first time period; determining whether the counter is timeout and a second video synchronization signal is not received; and in response to a determination that the counter is timeout and the second video synchronization signal is not received, controlling the backlight module to switch between lighting and not lighting multiple times within a second time period.

The above and other aspects of the invention will become better understood with regard to the following detailed description of the preferred but non-limiting embodiment (s). The following description is made with reference to the accompanying drawings.

DETAILED DESCRIPTION OF THE INVENTION

Figure 1:
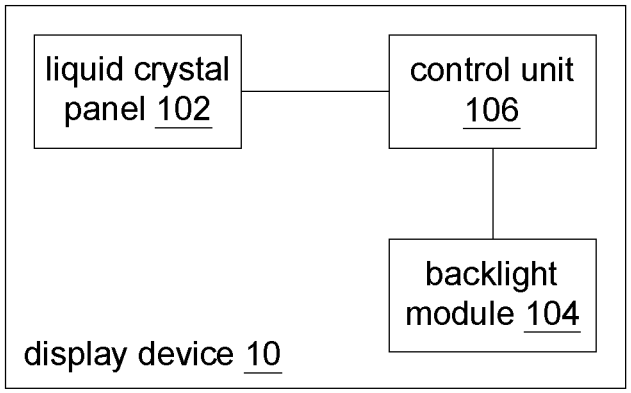
FIG. 1 is a block diagram of a display device according to an embodiment of the present invention.

Referring to FIG. 1, a block diagram of a display device according to an embodiment of the present invention is shown. The display device 10 includes a liquid crystal panel 102, a backlight module 104 and a control unit 106.

The liquid crystal panel 102 has a variable refresh rate (VRR), that is, the refresh rate of the liquid crystal panel 102 is dynamic and varies with time. The variable refresh rate ranges from a first frequency to a second frequency higher than the first frequency. In an embodiment, the first frequency can be 60 Hz, and second frequency f2 can be 120 Hz. The present invention does not specify the type of the liquid crystal panel 102, and any type of liquid crystal panel can be used. In an embodiment, the display device 10 can be coupled to a display interface card (not illustrated). When the display interface card operates, the frame rate of the display interface card varies with the complexity of the frame to be plotted. The refresh rate of the liquid crystal panel 102 with variable refresh rate can vary with the frame rate of the display interface card.

The backlight module 104 overlaps the liquid crystal panel 102. The backlight module 104 may include a surface light source. In an embodiment, the surface light source may include multiple light-emitting elements, such as various types of light-emitting diodes (LEDs).

The control unit 106 is coupled to the backlight module 104 to control the backlight module 104 to emit or not to emit light. In an embodiment, the control unit 106 is further coupled to the liquid crystal panel 102 to control the refresh rate of the liquid crystal panel 102. The control unit 106 can be a specific purpose control chip, a microcontroller or a specific purpose circuit, and is configured to perform the operation method of a backlight module disclosed in the present invention. For the present invention to be better understood, the operation method of a backlight module is disclosed below with accompanying drawings FIG. 2 and FIG. 3.

Figure 2:
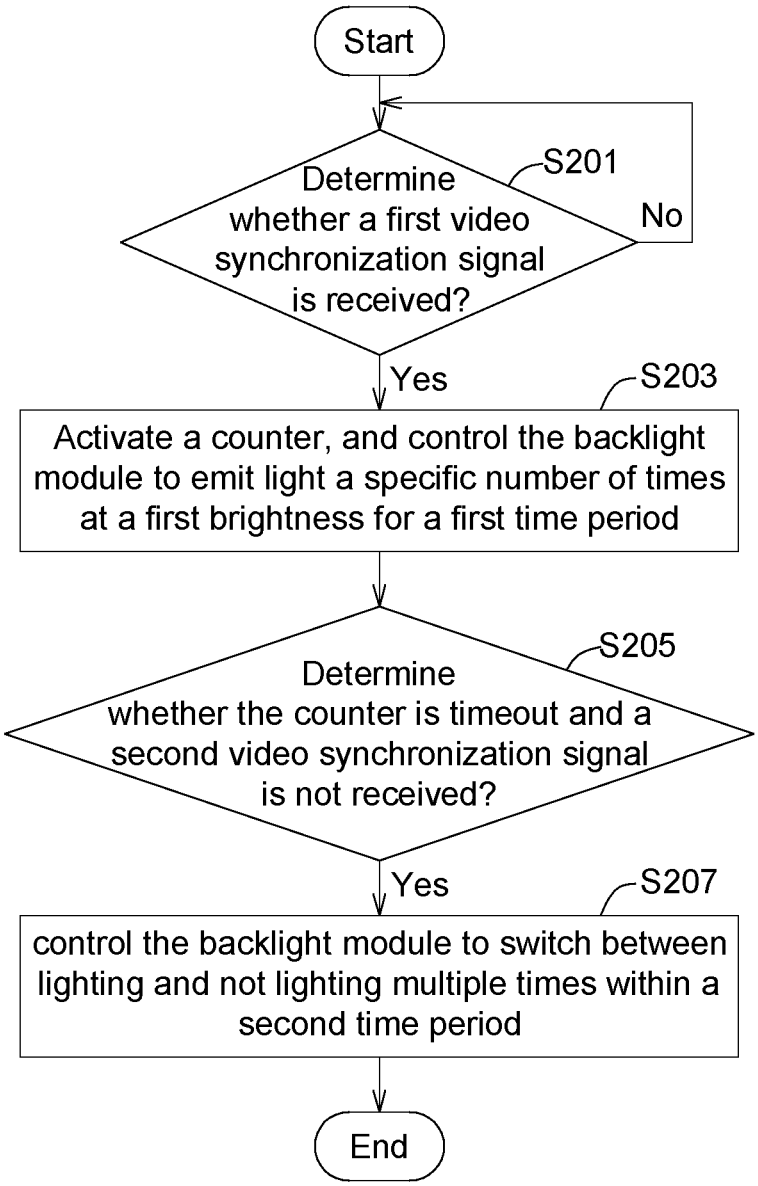
FIG. 2 is a flowchart of an operation method of a backlight module according to an embodiment of the present invention.

Referring to FIG. 2, a flowchart of an operation method of a backlight module according to an embodiment of the present invention is shown.

In step S201, whether a first video synchronization signal is received is determined by the control unit 106. The first video synchronization signal, which represents the end of a frame and the start of a new frame, can be transmitted by a display interface card and can be realized by such as a vertical synchronization (V-sync) signal. If the control unit 106 determines that the first video synchronization signal is received, the method performs step S203; otherwise, the method returns to step S201.

In step S203, a counter is activated, and the backlight module 104 is controlled by the control unit to emit light a specific number of times at a first brightness for a first time period. In an embodiment, the time period of the counter is the reciprocal of the second frequency. When the second frequency is 120 Hz, the time period of the counter is 1/120 sec. In an embodiment, the operation of controlling the backlight module 104 to emit light a specific number of times at the first brightness for the first time period will be completed before the counter is timeout. For example, after the first video synchronization signal is received and the counter is not timeout, the control unit 106 can control the backlight module 104 to emit light once (the specific number of times) at the first brightness for 1/480 sec (the first time period). In another embodiment, after the first video synchronization signal is received and the counter is not timeout, the control unit 106 can control the backlight module 104 to emit light twice (the specific number of times) at the first brightness for 1/960 sec (the first time period).

In step S205, whether the counter is timeout and a second video synchronization signal is not received is determined by the control unit 106. If the counter is not timeout, the method returns to step S205 (in the present embodiment, the second video synchronization signal will not be received before the counter is timeout). After the counter is timeout, the control unit 106 determines whether the second video synchronization signal is received, and then performs step S207 before the second video synchronization signal is received; and after the second video synchronization signal is received, the control unit 106 performs step S203 after resetting the counter. The second video synchronization signal can be another vertical synchronization signal different from the first video synchronization signal.

In step S207, the backlight module 104 is controlled by the control unit 106 to switch between lighting and not lighting multiple times within a second time period.

Figure 3:
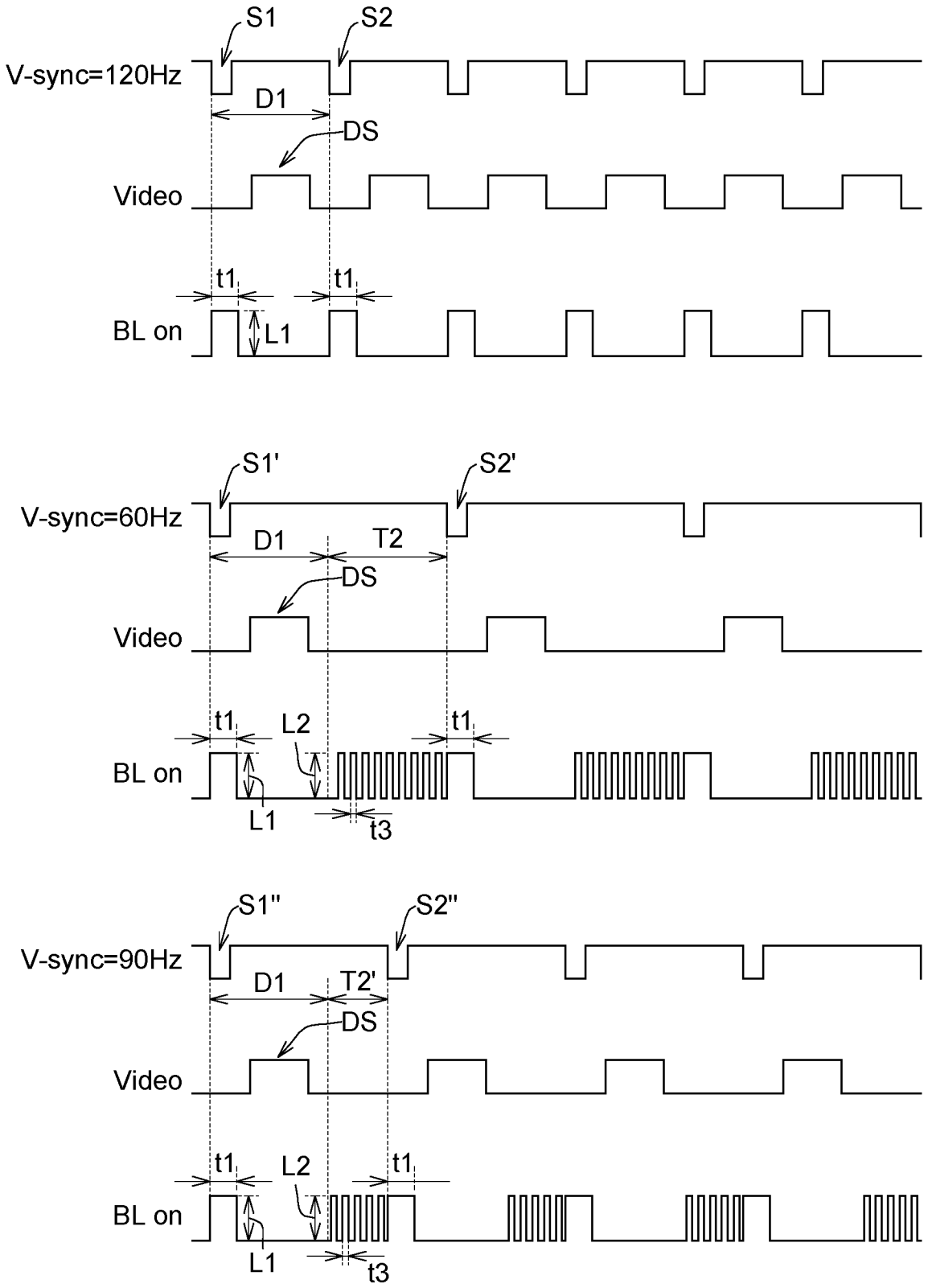
FIG. 3 is a schematic diagram of the luminescence time of a backlight module according to an embodiment of the present invention.

Referring to FIG. 3, a schematic diagram of the luminescence time of a backlight module according to an embodiment of the present invention is shown. The operation method of FIG. 2 can be better understood with reference to FIG. 3. In the present embodiment, suppose the refresh rate of the liquid crystal panel substantially synchronizes with the frame rate of the display interface card (despite a little delay may exist), that is, the refresh rate of the liquid crystal panel is substantially identical to the frame rate of the display interface card. As indicated in FIG. 3, "V-sync" represents the signal line/pin through which the control unit 106 receives the video synchronization signal; "Video" represents the signal line/pin through which the control unit 106 transmits the data signal to the liquid crystal panel; "BL on" represents the signal line/pin through which the control unit 106 controls the backlight module 104 to emit or not to emit light.

When the frame rate of the display interface card is 120 Hz, the refresh rate of the liquid crystal panel is also 120 Hz, and the transmission frequency of the vertical synchronization signal is 120 Hz. That is, the time difference between the first video synchronization signal S1 and the second video synchronization signal S2 is 1/120 sec (that is, the time period of the counter D1). During period D1, the control unit 106 controls the backlight module 104 to emit light once at the first brightness L1 for the first time period t1 (in other embodiments, the backlight module 104 can emit light more than once). Thus, during the period D1 when the liquid crystal panel is operated at the second frequency (120 Hz), the average brightness of the backlight module 104 is (L1*t1*k)/(1/f2), wherein k represents the specific number of times, f2 represents the value of the second frequency, and in the present embodiment, k is exemplified by 1 and f2 is exemplified by 120. Under such circumstance, the second time period is 0. In an embodiment, after receiving the first video synchronization signal, the control unit 106 receives a frame data from the display interface card, generates a data signal DS according to the frame data, and then transmits the data signal DS to the liquid crystal panel 102. In another embodiment, after receiving the first video synchronization signal, the control unit 106 transmits the data signal DS temporarily stored in a buffer to the liquid crystal panel 102.

It should be noted that, the first brightness can be fixed or variable. In another embodiment, the control unit 106 can control the backlight module 104 to emit light three times at the first brightness during the period D1, and the first brightness increases/decreases as the number of times increases.

Suppose the frame rate of the display interface card is 60 Hz. Under such circumstances, the refresh rate of the liquid crystal panel is also 60 Hz, and the transmission frequency of the vertical synchronization signal is 60 Hz. That is, the time difference between the first video synchronization signal S1' and the second video synchronization signal S2' is 1/60 sec. During the period D1, the control unit 106 controls the backlight module 104 to emit light once (the specific number of times) at the first brightness L1 for the first time period t1. Based on the above calculation, the average brightness of the backlight module 104 obtained when the liquid crystal panel is operated at the first frequency (60 Hz) during the period D1 is (L1*t1*k)/(1/f2) and is identical to the average brightness of the backlight module 104 obtained when the liquid crystal panel is operated at the second frequency (120 Hz). After the counter is timeout and before the second video synchronization signal S2' is received (that is, the second time period T2), the control unit 106 controls the backlight module 104 to switch between lighting and not lighting multiple times. In the present embodiment, the second time period is a difference between the reciprocal of the first frequency and the reciprocal of the second frequency. Within the second time period T2, the control unit 106 controls the backlight module 104 to periodically emit light at a second brightness L2 for a third time period t3. For the average brightness within the second time period to be identical to the average brightness during the period D1, the total number of times n which the backlight module 104 periodically emits light within the second time period at the second brightness L2 for the third time period t3 when the liquid crystal panel 102 is operated at the first frequency can be designed, such that the following equation can be met: (L2*t3*n)/((1/f1)−(1/f2))=(L1*t1)/(1/f2); and (L2*t3*n)/(L1*t1)=(f2−f1)/f1. In other words, when the second frequency is two times of the first frequency, the integral of the brightness of the backlight module 104 over time within the period between the time point at which the first video synchronization signal is received and the time point at which the counter is timeout is equivalent to the integral of brightness over time within the second time period. That is, the second brightness and the third time period can be determined according to the first brightness, the first time period, the specific number of times, the first frequency and the second frequency. In the present embodiment, since the pulse representing the luminance of the backlight module is uniformly distributed within the second time period T2, the average brightness within the period between the time point at which the counter is timeout and any time point within the second time period will be substantially identical to the average brightness within the period D1. In other words, when the refresh rate of the liquid crystal panel 102 is any frequency in a range between the first frequency and the second frequency, the control unit 106 can use the time point at which the counter is timeout as the starting point at which the backlight module 104 starts to periodically emit light at the second brightness for the third time period, and uses the time point at which the second video synchronization signal is received as the ending point at which the backlight module 104 finishes periodically emitting light at the second brightness for the third time period, and the average brightness of the time interval between the starting point and the ending point (that is, the second time period) will be substantially identical to the average brightness of the time interval between the time point at which the first video synchronization signal is received and the time point at which the counter is timeout.

Suppose the frame rate is 90 Hz. That is, when the liquid crystal panel 102 is operated at a refresh rate of 90 Hz, the time difference between the first video synchronization signal S1" and the second video synchronization signal S2" is 1/90 sec. The operation of the liquid crystal panel 102 operated at a refresh rate of 90 Hz during the period D1 is identical to that of the liquid crystal panel 102 operated at a refresh rate of 120 Hz, and the similarities are not repeated. The length of the second time period T2' is 1/360 sec, which is 1/3 of the second time period T2 (1/120) for which the liquid crystal panel is operated at a refresh rate of 60 Hz. Thus, the number of pulses representing the luminance of the backlight module is n/3 in theory. In other words, the average brightness of the backlight module 104 within the second time period T2' is substantially identical to the average brightness of the backlight module 104 during the period D1.

Under some circumstances, within the third time period, the control unit 106 may switch the backlight module to receive the second video synchronization signal when the backlight module emits light. To avoid the above situation, the third time period can be designed to be shorter, and the second brightness can be designed to be higher. For example, the second brightness is designed to be higher than the first brightness. Generally speaking, the second brightness is not lower than the first brightness.

Besides, after receiving the first video synchronization signal, the control unit 106 transmits the data signal DS to the liquid crystal panel 102. In an embodiment, the second time period starts when the data signal DS is completely transmitted.

In an embodiment, the control unit 106 determines a previous refresh rate according to a time interval between the reception of the second video synchronization signal and the reception of the first video synchronization signal and adjusts the second brightness according to the previous refresh rate. That is, the control module 106 can adaptatively adjust the brightness of the backlight module according to the previous refresh rate.

To summarize, the display device and the operation method of a backlight module disclosed in the present invention can effectively resolve the problem of the average brightness being different before and after frame insertion when the liquid crystal panel is operated at a variable refresh rate.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display device, comprising:

a liquid crystal panel having a variable refresh rate, which ranges from a first frequency to a second frequency higher than the first frequency;

a backlight module overlapping the liquid crystal panel; and a control unit coupled to the backlight module and configured to:

determine whether a first video synchronization signal (V-sync) is received;

in response to a determination that the first video synchronization signal is received, activate a counter for counting a time period, and control the backlight module to emit light a specific number of times at a first brightness for a first time period;

determine whether the counter is timeout and a second video synchronization signal is received or not;

in response to a determination that the counter is timeout and the second video synchronization signal is not received, control the backlight module to switch between lighting and not lighting multiple times within a second time period.

2. The display device according to claim 1, wherein the time period of the counter is the reciprocal of the second frequency.

3. The display device according to claim 1, wherein in the operation of controlling the backlight module to switch between lighting on and lighting off multiple times within a second time period, the control unit controls the backlight module to emit light periodically at a second brightness for a third time period, and the second brightness is not lower than the first brightness.

4. The display device according to claim 3, wherein the second brightness and the third time period are determined according to the first brightness, the first time period, the specific number of times, the first frequency and the second frequency.

5. The display device according to claim 1, wherein following the operation of controlling the backlight module to switch between lighting and not lighting multiple times within a second time period, the control unit is further configured to:

determine whether the second video synchronization signal is received; and in response to a determination that the second video synchronization signal is received, reset and activate the counter, and control the backlight module emit light the specific number of times at the first brightness for the first time period.

6. The display device according to claim 5, wherein the control unit is further configured to:

determine a previous refresh rate according to a time interval between the reception of the second video synchronization signal and the reception of the first video synchronization signal is received; and adjust the second brightness according to the previous refresh rate.

7. The display device according to claim 1, wherein when the liquid crystal panel is operated at the second frequency, the second time period is 0.

8. The display device according to claim 7, wherein when the liquid crystal panel is operated at the first frequency, the second time period is a difference between the reciprocal of the second frequency and the reciprocal of the first frequency.

9. The display device according to claim 7, wherein when the second frequency is two times of the first frequency and the liquid crystal panel is operated at the first frequency, the integral of brightness over time within a period between the time point at which the backlight module receives the first video synchronization signal and the time point at which the counter is timeout is equivalent to the integral of brightness over time within the second time period.

10. The display device according to claim 1, wherein in response to the determination that the first video synchronization signal is received, the control unit transmits a data signal to the liquid crystal panel, and the second time period starts when the data signal is completely transmitted.

11. An operation method of a backlight module performed by a control unit of a display device, wherein the display device comprises a liquid crystal panel and a backlight module, the liquid crystal panel has a variable refresh rate, which ranges from a first frequency to a second frequency higher than the first frequency, and the operation method comprises:

determining whether a first video synchronization signal (V-sync) is received;

in response to a determination that the first video synchronization signal is received, controlling the backlight module to emit light a specific number of times at a first brightness for a first time period and activating a counter for counting a time period;

determining whether the counter is timeout and a second video synchronization signal is received or not;

in response to a determination that the counter is timeout and the second video synchronization signal is not received, controlling the backlight module to switch between lighting on and lighting off multiple times within a second time period.

12. The operation method according to claim 11, wherein the time period of the counter is the reciprocal of the second frequency.

13. The operation method according to claim 11, wherein in the step of controlling the backlight module to switch between lighting and not lighting multiple times within a second time period, the control unit controls the backlight module to emit light periodically at a second brightness for a third time period, and the second brightness is not lower than the first brightness.

14. The operation method according to claim 13, wherein the second brightness and the third time period are determined according to the first brightness, the first time period, the specific number of times, the first frequency and the second frequency.

15. The operation method according to claim 11, wherein following the step of controlling the backlight module to switch between lighting and not lighting multiple times within a second time period, the method further comprises:

determining whether the second video synchronization signal is received; and in response to a determination that the second video synchronization signal is received, resetting and activating the counter, and controlling the backlight module emit light the specific number of times at the first brightness for the first time period.

16. The operation method according to claim 15, further comprising:

determining a previous refresh rate according to a time interval between the reception of the second video synchronization signal and the reception of the first video synchronization signal is received; and adjusting the second brightness according to the previous refresh rate.

17. The operation method according to claim 11, wherein when the liquid crystal panel is operated at the second frequency, the second time period is 0.

18. The operation method according to claim 17, wherein when the liquid crystal panel is operated at the first frequency, the second time period is a difference between the reciprocal of the second frequency and the reciprocal of the first frequency.

19. The operation method according to claim 17, wherein when the second frequency is two times of the first frequency and the liquid crystal panel is operated at the first frequency, the integral of brightness over time within a period between the time point at which the backlight module receives the first video synchronization signal and the time point at which the counter is timeout is equivalent to the integral of brightness over time within the second time period.

20. An operation method of a backlight module performed by a control unit of a display device, wherein the display device comprises a liquid crystal panel and a backlight module, the liquid crystal panel has a variable refresh rate, which ranges from a first frequency to a second frequency higher than the first frequency, the operation method comprises:

(a) controlling the backlight module to emit light a specific number of times at a first brightness for a first time period and activating a counter for counting a time period when a first video synchronization signal (V-sync) is received, wherein the time period of the counter is the reciprocal of the second frequency;

(b) controlling the backlight module to switch between lighting on and lighting off multiple times within a second time period when the counter is timeout and the second video synchronization signal is not received; and (c) in response to the second video synchronization signal is received, stopping the second time period and resetting the counter, and repeats step (a).

* * * * *